US008253632B2

(12) United States Patent
Kurashima

(10) Patent No.: US 8,253,632 B2
(45) Date of Patent: Aug. 28, 2012

(54) TRANSMITTING AND RECEIVING APPARATUS

(75) Inventor: Shigemi Kurashima, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 158 days.

(21) Appl. No.: 12/078,943

(22) Filed: Apr. 8, 2008

(65) Prior Publication Data

US 2009/0140932 A1 Jun. 4, 2009

(30) Foreign Application Priority Data

Nov. 29, 2007 (JP) ..... 2007-308621

(51) Int. Cl.
*H01Q 1/24* (2006.01)

(52) U.S. Cl. ..... 343/702; 343/700 MS

(58) Field of Classification Search ..... 343/700 MS, 343/702

See application file for complete search history.

(56) References Cited

U.S. PATENT DOCUMENTS

| | | | | |
|---|---|---|---|---|
| 5,193,220 | A * | 3/1993 | Ichinohe et al. | 455/343.1 |
| 6,762,728 | B2 * | 7/2004 | Koyama et al. | 343/718 |
| 7,075,483 | B2 * | 7/2006 | Okado | 343/700 MS |
| 7,764,236 | B2 * | 7/2010 | Hill et al. | 343/702 |
| 2004/0063438 | A1 * | 4/2004 | Hsu et al. | 455/452.1 |
| 2006/0187133 | A1 * | 8/2006 | Matoge | 343/745 |
| 2008/0143634 | A1 * | 6/2008 | Tsutsui et al. | 343/873 |

FOREIGN PATENT DOCUMENTS

| | | |
|---|---|---|
| JP | 2004-242105 | 8/2004 |
| JP | 2005-115919 | 4/2005 |
| JP | 2007-274099 | 10/2007 |

* cited by examiner

*Primary Examiner* — Jacob Y Choi
*Assistant Examiner* — Kyana R McCain
(74) *Attorney, Agent, or Firm* — Staas & Halsey LLP

(57) ABSTRACT

A disclosed transmitting and receiving apparatus includes a UWB antenna having an element pattern and battery disposed on a side of the element pattern so that satisfactory antenna characteristics are obtained. The transmitting and receiving apparatus includes the UWB antenna having the element pattern, a ground pattern, and the battery disposed on a side of the element pattern. Preferably, the width and the height of the element pattern are about 16 mm and about 15 mm, respectively, and the distance between the element pattern and the battery is about 7 mm.

12 Claims, 12 Drawing Sheets

TRANSMITTING AND RECEIVING APPARATUS

BACKGROUND OF THE INVENTION

1. Field of the Invention

The present invention generally relates to a transmitting and receiving apparatus and more specifically to a portable compact transmitting and receiving apparatus having a casing accommodating an antenna and a battery.

2. Description of the Related Art

Recently, a positioning system based on an Ultra Wide Band (UWB) radio technology using wide band radio waves has been investigated. The positioning system includes a system for determining the position of a customer who is in a shop, for example. In the system, a transmitting and receiving apparatus (UWB tag) is provided to be carried by a customer or mounted on a shopping cart used by the customer in the shop. Further, plural communication devices (base stations) separated from each other are provided in predetermined areas in the shop. The position of the customer is detected by the signal communications between the transmitting and receiving apparatus and the communication devices.

In this case, the transmitting and receiving apparatus is desired to be thin and compact because it is assumed that the customers wear straps of the transmitting and receiving apparatuses around their neck in practical cases.

The applicant et al. of the present invention have applied a plane antenna including a home-plate shaped element pattern and a substantially square-shaped ground pattern disposed in the vicinity of the element pattern as a UWB antenna. The UWB antenna is preferably used for a thin transmitting and receiving apparatus. In addition, preferably, a button cell battery may be used to reduce the thickness of the transmitting and receiving apparatus.

Unfortunately, in the technical field of the UWB antenna for such a portable apparatus, no remarkable research focusing on how a layout of the element pattern and the button cell battery influences the antenna characteristics has been made.

SUMMARY OF THE INVENTION

The present invention is made in light of the above circumstances and may provide a transmitting and receiving apparatus having a UWB antenna with improved antenna characteristics.

According to an aspect of the present invention, there is provided a transmitting and receiving apparatus including a UWB antenna including a home-plate shaped element pattern having a triangular shaped part at one end side in the height direction, and a ground pattern on an apex side of the triangular shaped part of the element pattern; and a battery disposed on one side of the element pattern and separated from the element pattern by a prescribed distance so that the influence of the element pattern on the characteristics of the UWB antenna is within an allowable range.

According to an embodiment of the present invention, the transmitting and receiving apparatus is capable of having satisfactory antenna characteristics.

BRIEF DESCRIPTION OF THE DRAWINGS

Other objects, features, and advantages of the present invention will become more apparent from the following descriptions when read in conjunction with the accompanying drawings, in which.

DETAILED DESCRIPTION OF THE PREFERRED EMBODIMENTS

Next, an embodiment of the present invention is described with reference to the accompanying drawings.

Figure 1:
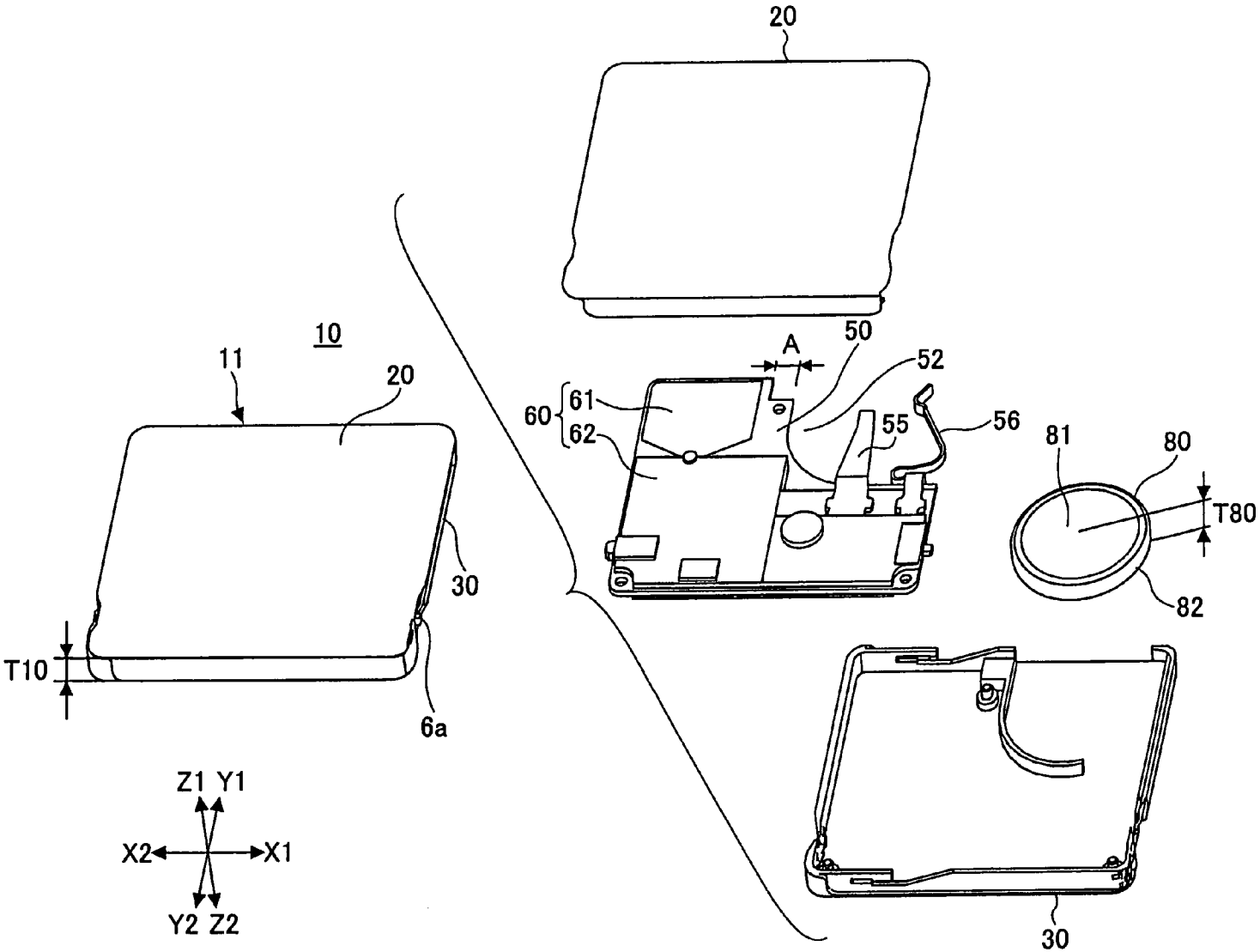
FIG. 1 is an exploded perspective view showing a transmitting and receiving apparatus according to an embodiment of the present invention.
Figure 2:
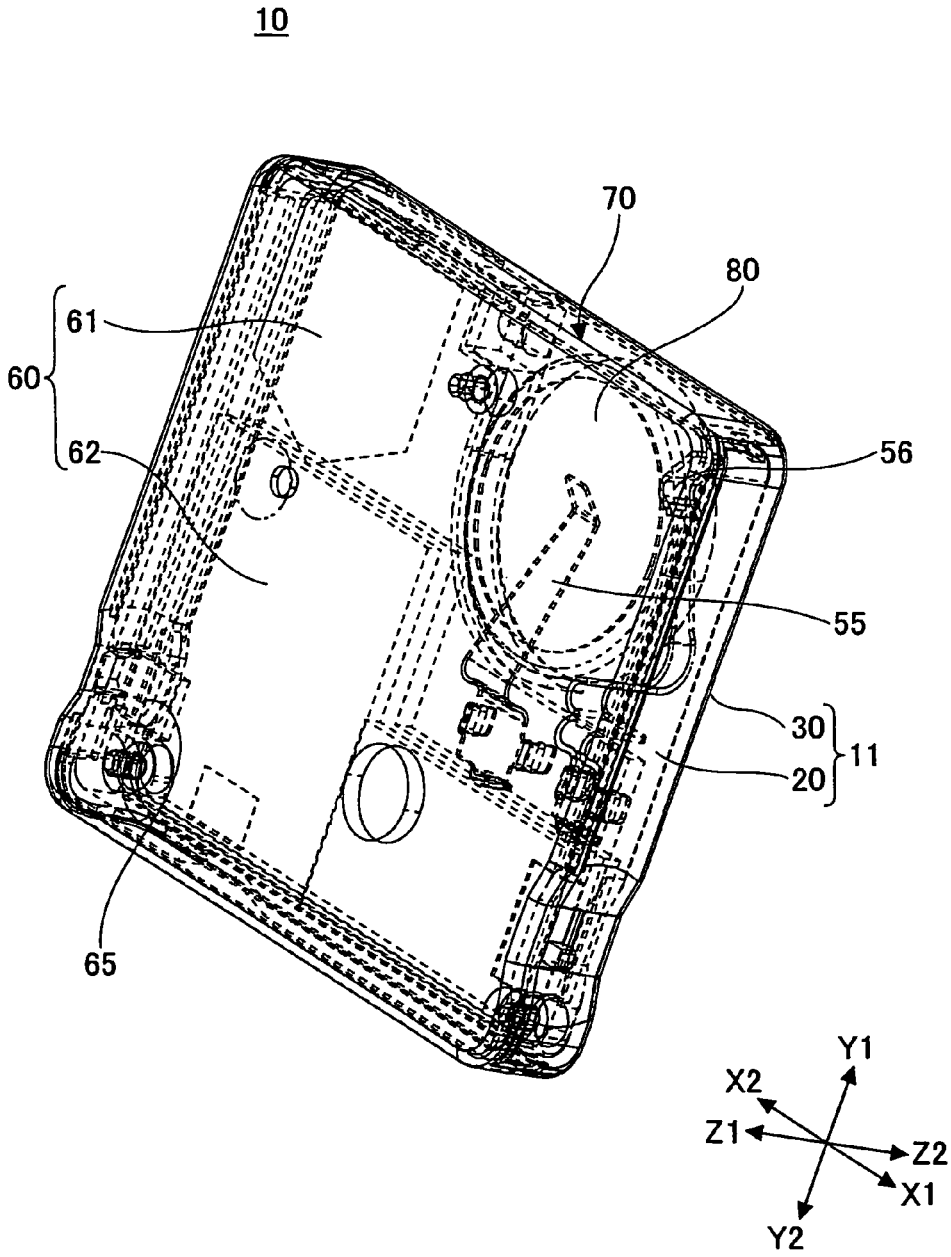
FIG. 2 is an oblique perspective view schematically showing the inside of the transmitting and receiving apparatus.
Figure 3A:
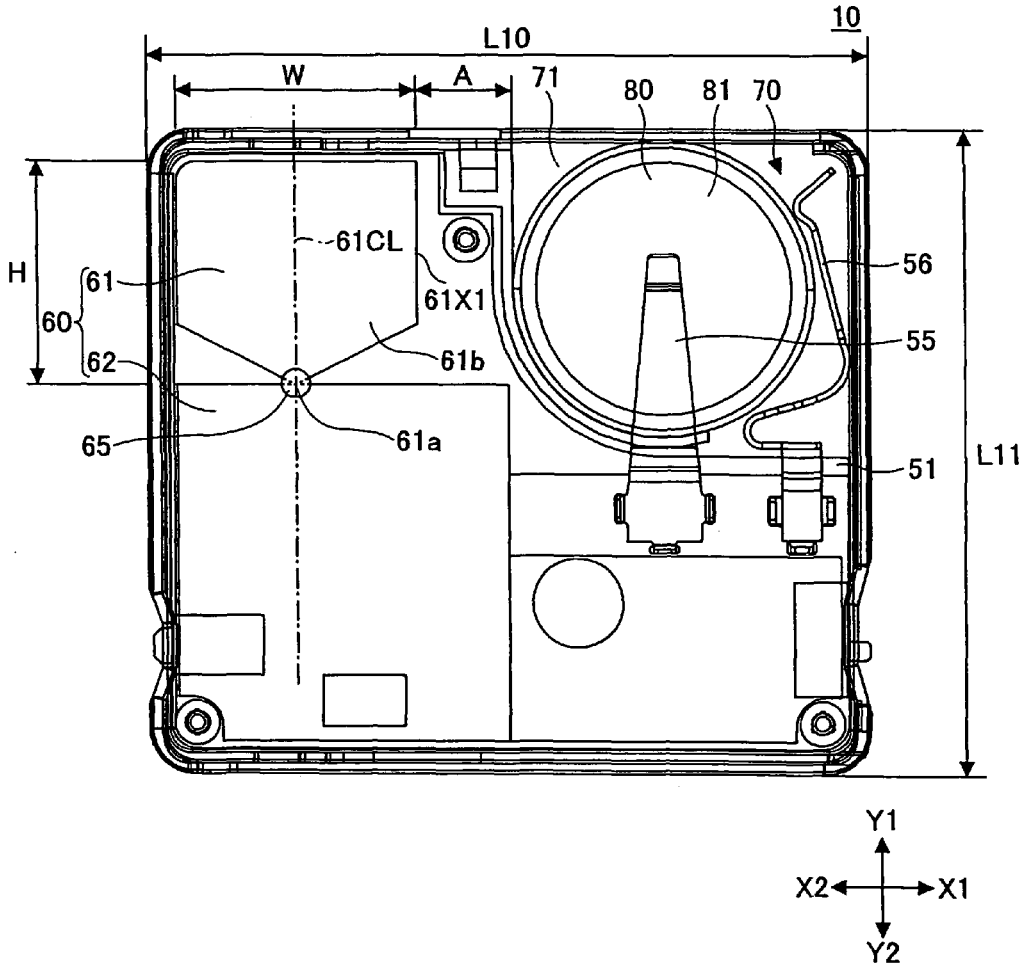
FIGS. 3A and 3B are plan and front perspective views, respectively, of the transmitting and receiving apparatus.
Figure 3B:
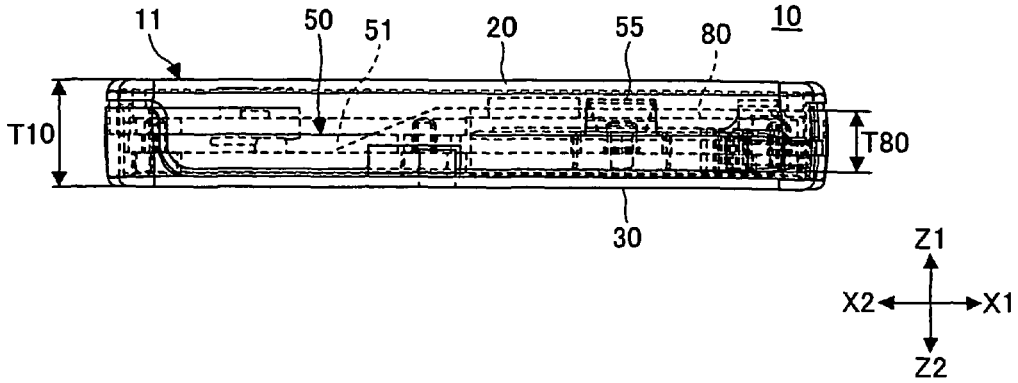

FIG. 1 is an exploded perspective view showing a portable transmitting and receiving apparatus (UWB tag) 10 according to an embodiment of the present invention. FIG.2 is a perspective view showing the inside of the transmitting and receiving apparatus 10. FIG. 3A is a plan view showing the inside of the transmitting and receiving apparatus 10. FIG. 3B is a front view from the Y2 side of the transmitting and receiving apparatus 10. In the figures, the X1-X2, Y1-Y2, and Z1-Z2 directions denote the width, the longitudinal (height), and the thickness directions, respectively.

As shown in FIGS. 1 through 3B, the transmitting and receiving apparatus 10 includes a flat casing 11, a transmitting and receiving module 50, a button cell battery accommodating section 70, and a button cell battery 80. The flat casing 11 includes an upper half case 20 and a lower half case 30, both made of synthetic resin. The transmitting and receiving apparatus module 50 is accommodated in the casing 11 and has transmitting and receiving functions. The button cell battery 80 is accommodated in the button cell battery accommodating section 70 in the casing 11. As shown in FIG. 3A, the transmitting and receiving apparatus 10 has a substantially square shape and has the sizes of approximately 40 mm width "L10", approximately 45 mm height "L11", and approximately 8 mm thickness "T10".

When the transmitting and receiving apparatus 10 is put to practical use in a manner where a user wears a strap of the transmitting and receiving apparatus 10 around the neck, the Y1-Y2 direction becomes the vertical (height) direction.

The transmitting and receiving module 50 includes a circuit substrate 51 having a built-in UWB antenna 60, IC parts (not shown) mounted on the circuit substrate 51, and a negative electrode terminal member 55 and a positive electrode terminal member 56, each fixed in the vicinity of a fringe of the circuit substrate 51.

The circuit board 51 has a square shape, and includes a cutout part 52 at the corner between the X1 side and the Y1 side for accommodating the button cell battery 80.

As shown in FIG. 4 as well, the UWB antenna 60 includes a home-plate shaped element pattern 61 having a triangle shape part 61*b* on the Y2 side of the UWB antenna 60, a substantially L-shaped ground pattern 62, and a ground pattern part 64 formed by the button cell battery 80 described below. The combination of the ground pattern 62 and the ground pattern part 64 is herein referred to as a practical ground pattern 63. The element pattern 61 has a symmetric shape with respect to a center line "61CL". The element pattern 61 and the ground pattern 62 are disposed on the Y1 side and the Y2 side, respectively, with respect to each other. As shown in FIG. 3A, there is a triangle part 61*b* on the Y2 side the element pattern 62, and there is an apex 61*a* on the Y2 side of the triangle part 61*b*. The apex 61*a* is close to an edge on the Y1 side of the ground pattern 62. The position of the edge on the X2 side of the element pattern 61 corresponds to the position of the edge on the X2 side of the circuit substrate 51 in the x axis direction, so that the distance between the element pattern 61 and the cutout part 52 in the x axis direction is maximized. Further, the element pattern 61 and the ground pattern 62 are formed on the upper surface of the circuit substrate 51 by an etching process. Still further, the surfaces of the element pattern 61 and the ground pattern 62 are covered with an insulation film. Still further, there is provided a coaxial connector 65 surface-mounted on the upper surface of the circuit substrate 51 and is positioned above both a part of the element pattern 61 and a part of the ground pattern 62.

The center frequency of the UWB antenna 60 is, for example, 4.5 GHz. The element pattern 61 has sizes of approximately 16 mm width "W" and approximately 15 mm height "H".

Both the negative electrode terminal member 55 and the positive electrode terminal member 56 protrude into the cutout part 52.

The button cell battery accommodating section 70 includes a space 71 defined by the cutout part 52 inside the casing 11. The space 71 accommodates the protruding negative electrode terminal member 55 and the protruding positive electrode terminal member 56.

As shown in FIG. 1, when the button cell battery 80 having a button-shape is installed in the button cell battery accommodating section 70, the negative electrode surface 81 and the positive electrode surface of the button cell battery 80 are on the Z1 and Z2 sides and are in contact with the negative electrode terminal member 55 and the positive electrode terminal member 56, respectively.

In the transmitting and receiving apparatus 10 according to the embodiment of the present invention, the UWB antenna 60 and the button cell battery accommodating section 70 (the button. cell battery 80) are arranged so that the button cell battery accommodating section 70 (the button cell battery 80) is on the X1 side of the element pattern 61 of the UWB antenna 60. Because of this arrangement, the transmitting and receiving apparatus 10 becomes reasonably compact. Furthermore, advantageously, it is considered that from a high frequency point of view, both the negative electrode surface 81 and the positive electrode surface 82 of the button cell battery 80 installed in the button cell battery accommodating section 70 serve as ground patterns.

In FIG. 3, the distance "A" between the end on the X1 side of the element pattern 61 and the end on the X2 side of the end of the button cell battery 80 (the end on the X2 side of the circumference of the button cell battery 80) is 7 mm. That is, the circumferential surface of the button cell battery 80 installed in the button cell battery accommodating section 70 faces and is separated from an end 61X1 on the X1 side of the element pattern 61 by 7 mm so as to be side by side. Further, the element electrode surface 81 of the button cell battery 80 is in substantially the same plane as the extended plane of the element pattern 61. Because of the distance "A" of 7 mm, the UWB antenna 60 is capable of having acceptable antenna characteristics. More particularly, the reduction of the gain due to the characteristics of the button cell battery 80 is within an allowable range, thereby realizing satisfactory antenna characteristics.

It should be noted that the UWB antenna 60 transmits and receives impulses having a very short pulse width approximately 5 ns.

Next, the antenna characteristics (direction pattern) of the UWB antenna 60 is described.

[Simulation]

Figure 4A:
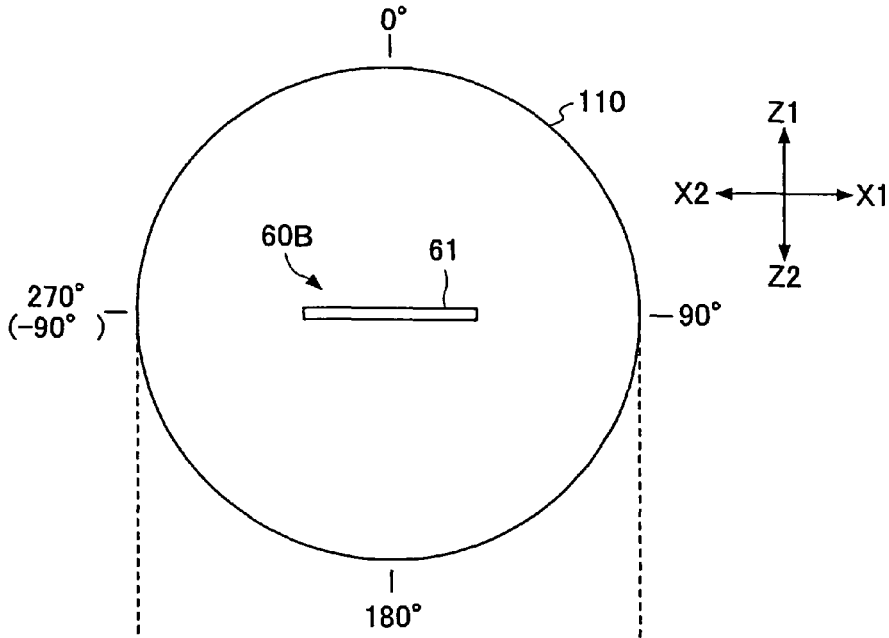
FIGS. 4A and 4B show a UWB antenna of the transmitting and receiving apparatus and typical antenna characteristics of the UWB antenna.
Figure 4B:
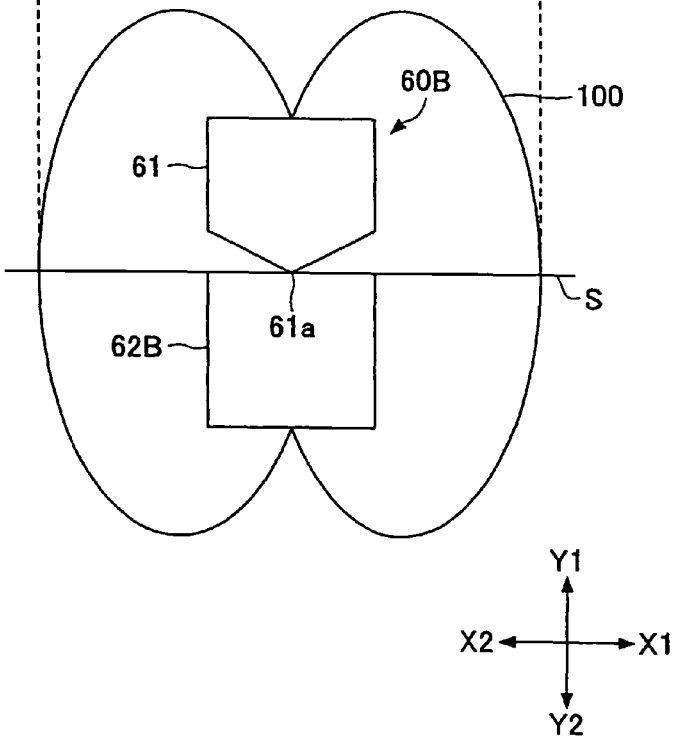

FIGS. 4A and 4B show the antenna characteristics of a typical UWB antenna 60B having a home-plate shaped element pattern 61 and a substantially square-shaped ground pattern 62B. The antenna characteristics of the UWB antenna 60B are formed in three dimensions and the shape of the antenna characteristics is like an apple. The solid line 100 in FIG. 4B shows the directional pattern in the X-Y plane including the UWB antenna 60B, that is an X-Y plane directional pattern. On the other hand, the solid line 110 in FIG. 4A shows the directional pattern cut in a X-Z plane "S" including the apex 61*a* of the element pattern 61 and has a substantially circular shape.

Figure 5:
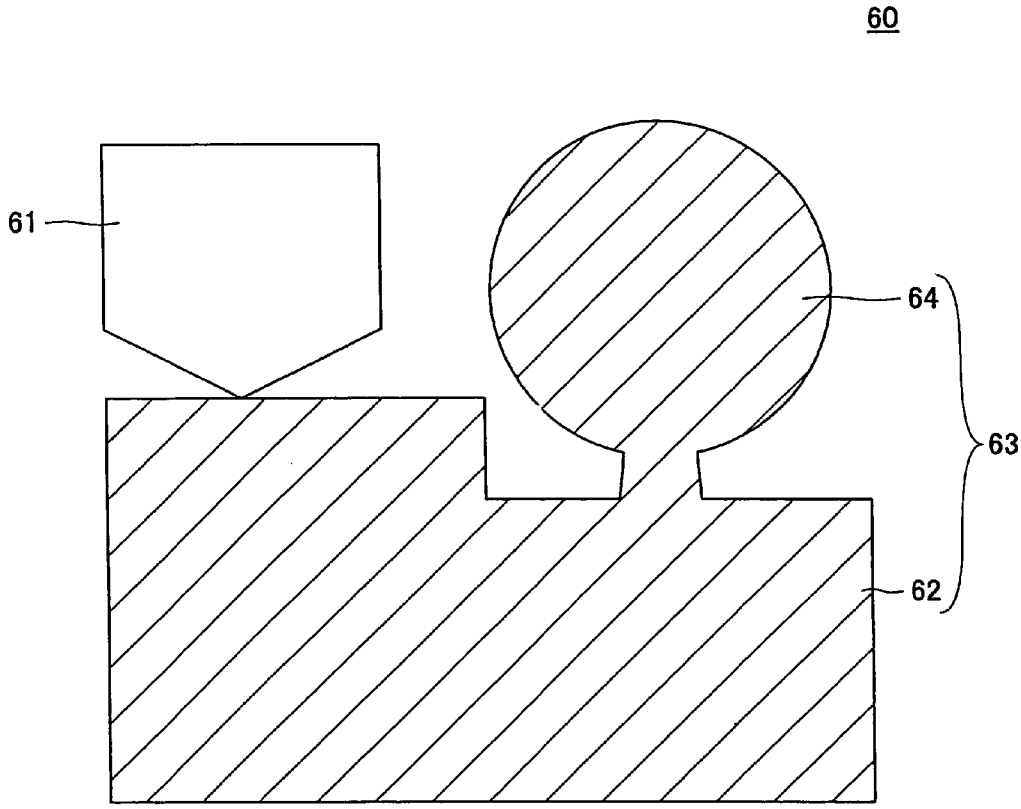
FIG. 5 is a view schematically showing the UWB antenna in the transmitting and receiving apparatus in FIG. 1.

FIG. 5 schematically shows a configuration of the UWB antenna 60. As shown in FIG. 5, the UWB antenna 60 includes the element pattern 61 and a practical ground pattern 63 (hatching area in FIG. 5). The practical ground pattern 63 includes a patterned ground pattern 62 and a ground pattern part 64 formed by the button cell battery 80.

Figure 6:
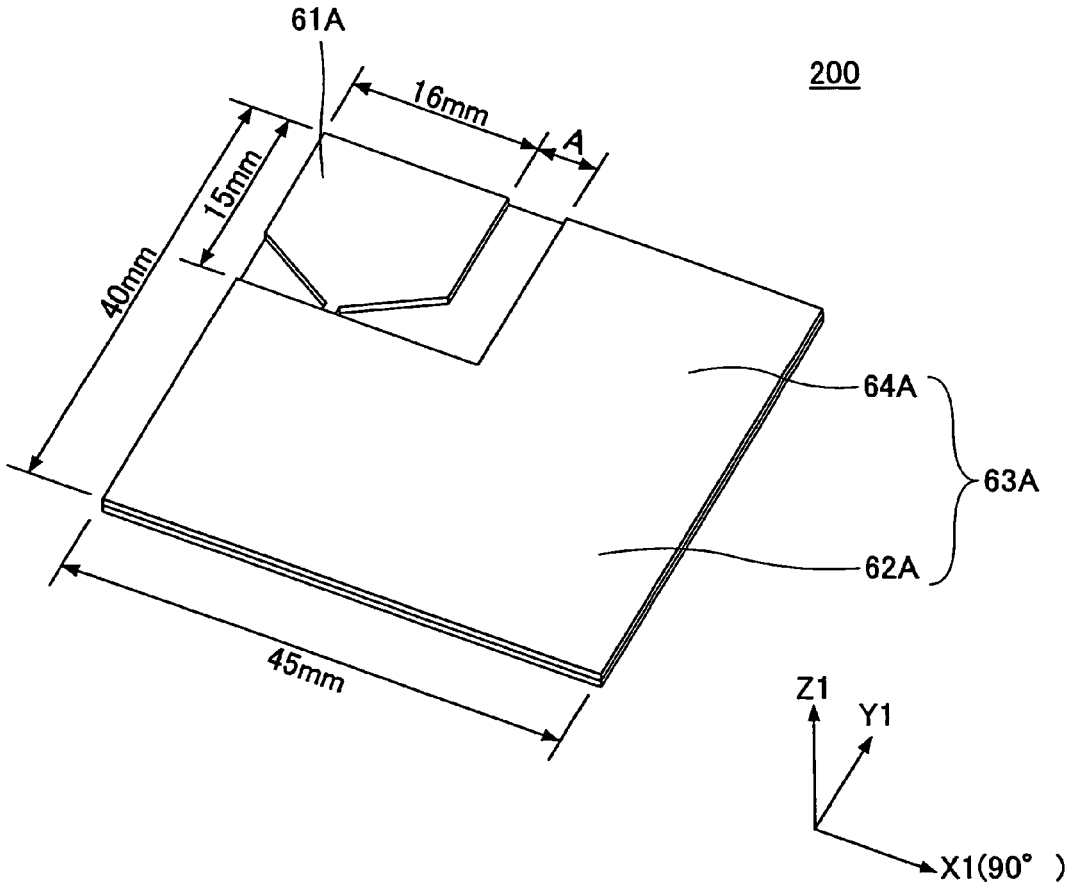
FIG. 6 is a drawing showing an analysis model resembling the UWB antenna for simulation.

First, an analysis is performed by simulation. FIG. 6 shows an analysis model 200 resembling the UWB antenna 60 for the simulation. The parts same as those in FIG. 5 are denoted by the same reference numerals having a suffix "A".

In the simulation, an edge on the X2 side of the ground pattern part 64A is moved in the X axis direction. As shown in FIG. 6, a symbol "A" denotes the distance between the edge of on the X2 side of the ground pattern part 64A and an edge on the X1 side of the element pattern 61A. In the simulation, the distance "A" is gradually increased from 3 mm to 26 mm, namely a gap between the ground pattern part 64A and the element part 61A is gradually broadened. Then, the antenna characteristics in the X-Z plane at the frequency of 4.5 GHz is obtained by calculation.

Figure 7:
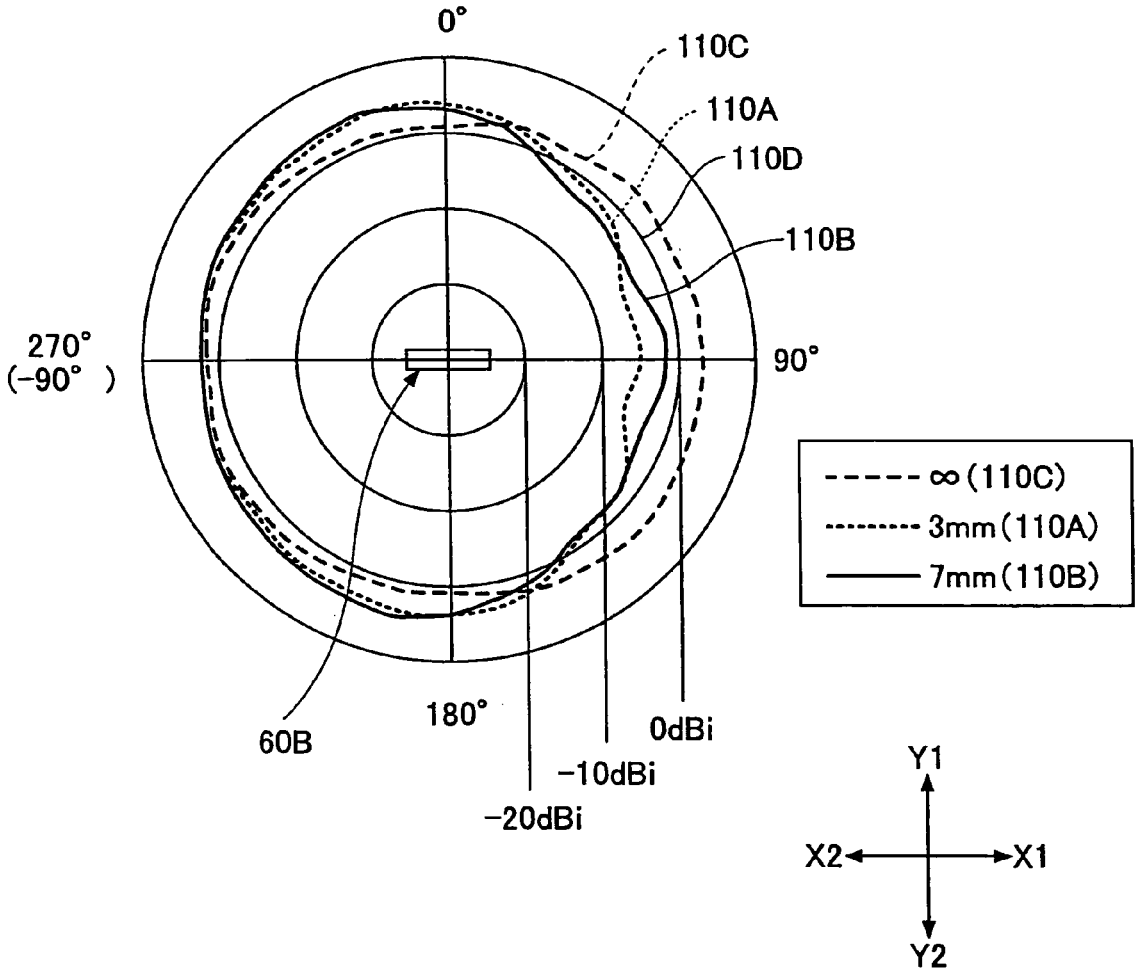
FIG. 7 is a graph showing the antenna characteristics obtained by the simulation using the analysis model in FIG. 6.

FIG. 7 shows antenna characteristics simulated while the distance "A" is changed. In FIG. 7, the lines 110A, 110B, and 110C show the antenna characteristics in the X-Z plane when the distance "A" is 3 mm, 7 mm, and infinity (∞), respectively. The solid line 110D shows substantially circular-shaped antenna characteristics in the X-Z plane when the distance "A" is 23 mm.

In the vicinity of 90 degrees in the graph of FIG. 7, the antenna characteristics are degraded due to the ground pattern part 64 reducing the gain on the X1 side of the element pattern 61A.

Figure 8:
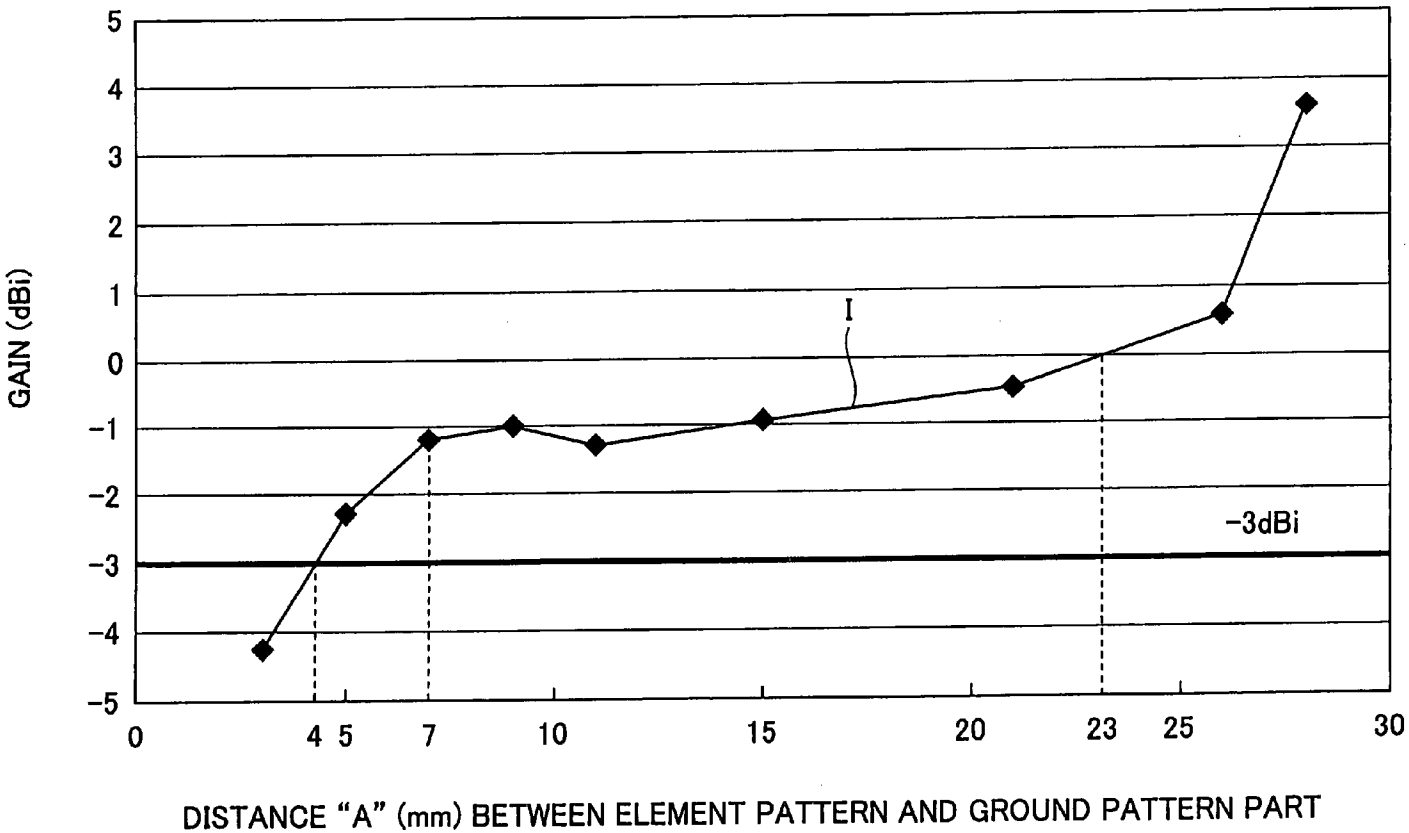
FIG. 8 is a graph showing the relationship between the distance between an element pattern and a ground pattern part in the 90 degree direction and the gain obtained by the simulation using the analysis model in FIG. 6.

The solid line "I" in FIG. 8 shows the antenna characteristics on the X1 side (90-degree direction) of the element pattern 61A. In FIG. 8, the horizontal axis denotes the distance "A", and the vertical axis denotes the gain in the 90-degree direction. As shown in FIG. 8, the gain is 0 dBi when the distance "A" is 23 mm, the gain is −1 dBi when the distance "A" is 7 mm, and the gain is −4 dBi when the distance "A" is 3 mm.

Further, the solid line "I" in FIG. 8 shows that as the distance "A" decreases, the gain tends to be decreased. Particularly, as the distance "A" decreases in an area where the distance "A" is 7 mm or less, the gain decreased abruptly.

In antenna characteristics it is generally assumed that the minimum allowable gain after reduction is 70% of a ideal gain. Namely, gain reduction down to −3 dBi is the allowable maximum.

Referring back to the graph in FIG. 8, the distance "A" where the gain reduction is −3 dBi is approximately 4 mm.

The above simulation result suggests that in the UWB antenna, the distance "A" should be 4 mm or more, namely the distance "A" should not be less than 4 mm.

[Measurements]

FIGS. 9B through 9E show the antenna characteristics in the X-Z plane of the UWB antenna 60 of the transmitting and receiving apparatus 10 in FIG. 1 when the button cell battery 80 is not installed. On the other hand, FIGS. 10B through 10E show the antenna characteristics in the X-Z plane of the UWB antenna 60 when the button cell battery 80 is installed.

Figure 9B:
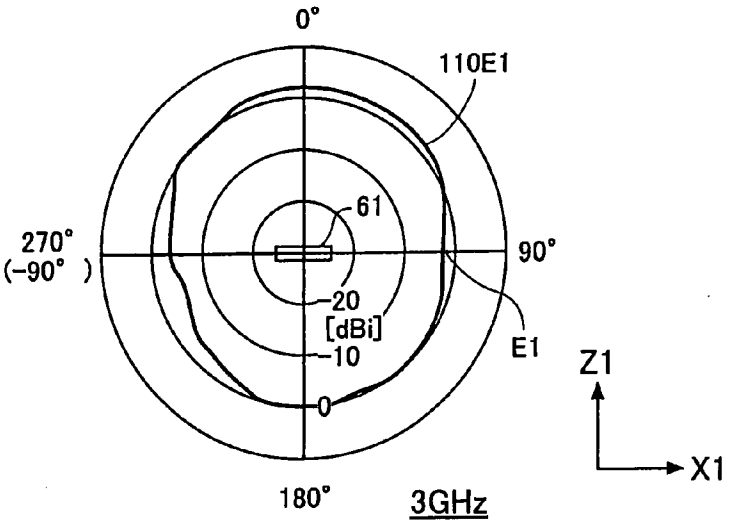
FIGS. 9B through 9E are graphs showing measured antenna characteristics of the transmitting and receiving apparatus in FIG. 9A (without battery)
Figure 9A:
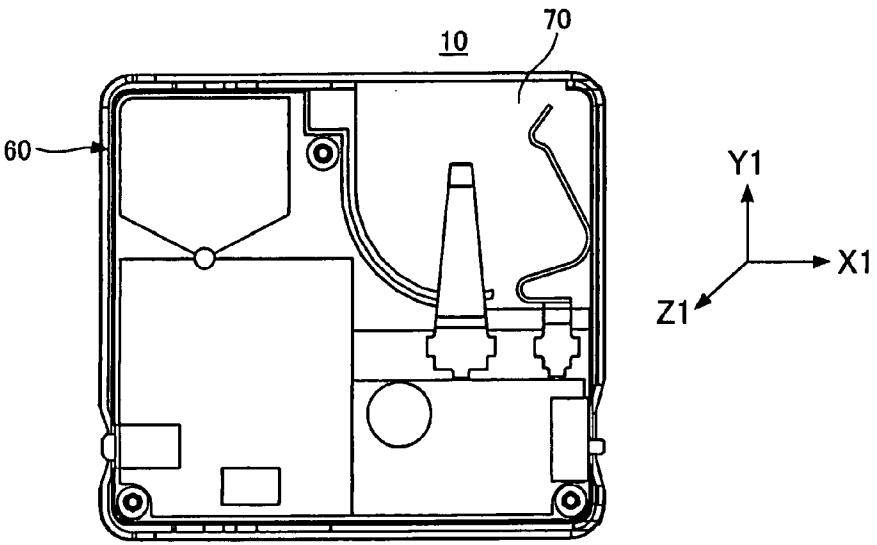
FIG. 9A is a drawing showing the transmitting and receiving apparatus without a battery.

More specifically, FIG. 9A shows the transmitting and receiving apparatus 10 in which no button cell battery 80 is installed. FIGS. 9B through 9E show the antenna characteristics in the X-Z plane of the UWB antenna 60 in the frequencies of 3 GHz, 4 GHz, 4.5 GHz, and 5 GHz, respectively.

Figure 10B:
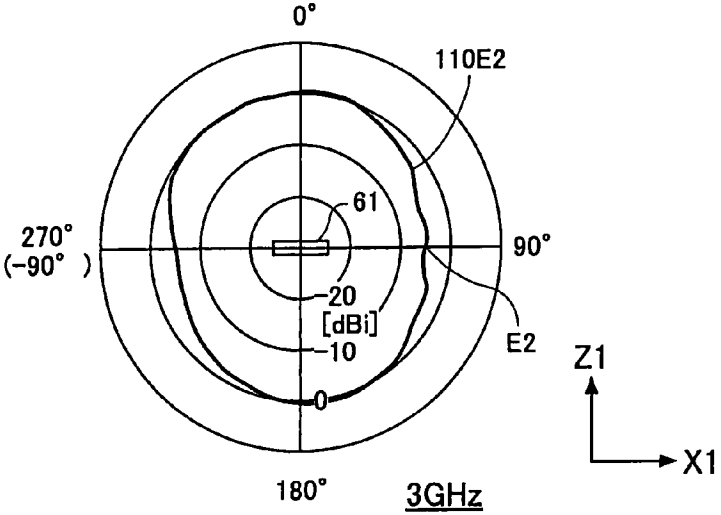
FIGS. 10B through 10E are graphs showing measured antenna characteristics of the transmitting and receiving apparatus in FIG. 10A (with battery).
Figure 10A:
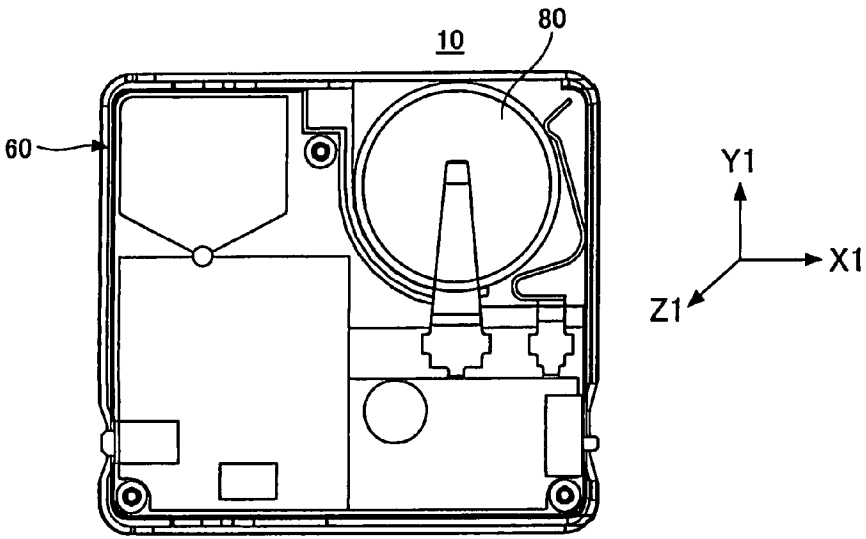
FIG. 10A is a drawing showing the transmitting and receiving apparatus including a battery.

FIG. 10A shows the transmitting and receiving apparatus 10 in which the button cell battery 80 is installed. FIGS. 10B through 10E show the antenna characteristics in the X-Z plane of the UWB antenna 60 at the frequencies of 3 GHz, 4 GHz, 4.5 GHz, and 5 GHz, respectively.

Figure 9C:
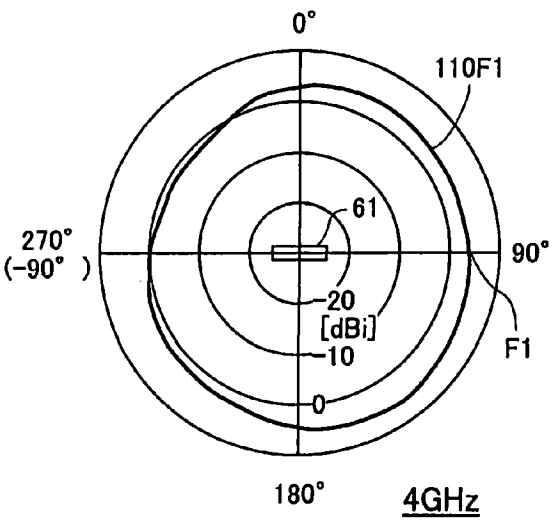
Figure 9D:
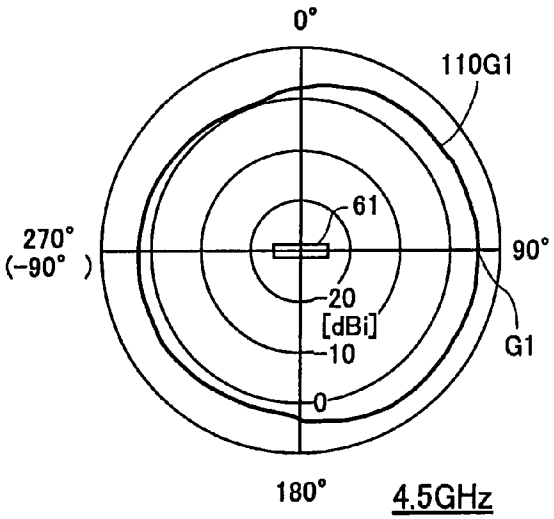
Figure 10C:
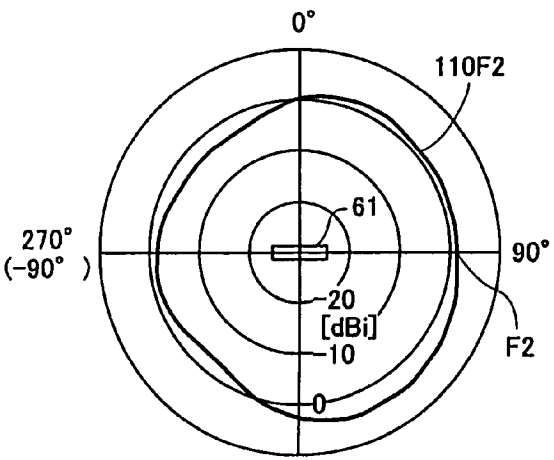
Figure 10D:
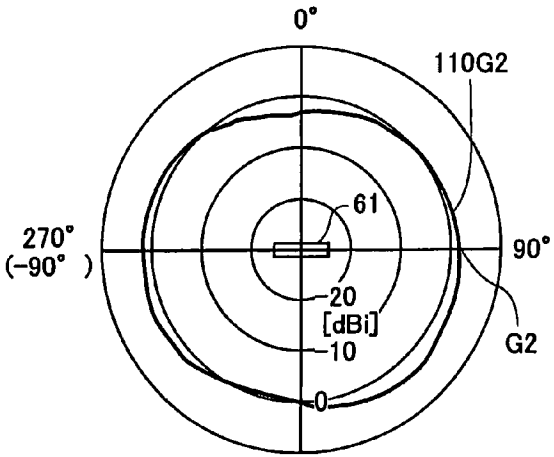

When the gains in the X1 (90 degree) direction at the frequency of 4.5 GHz are compared based on FIGS. 9D and 10D, the gain "G2" in FIG. 10D is almost the same as the gain "G1" in FIG. 9D.

This result indicates that the result obtained by the above simulation is correct.

Figure 9E:
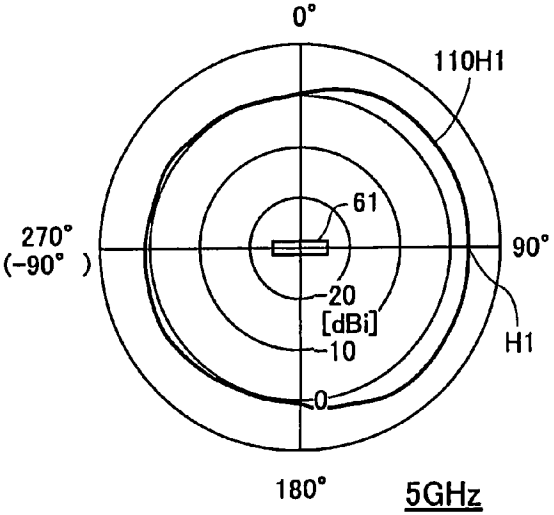
Figure 10E:
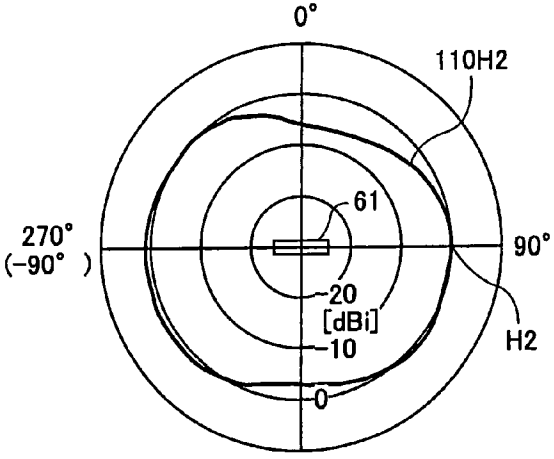

Similarly, when the gains in the X1 (90 degree) direction in the frequency of 3 GHz are compared based on FIGS. 9B and 10B, the gain "E2" in FIG. 10B is almost the same as the gain "E1" in FIG. 9B; when the gains in the X1 (90 degree) direction in the frequency of 4 GHz are compared based on FIGS. 9C and 10C, the gain "F2" in FIG. 10C is almost the same as the gain "F1" in FIG. 9C; and when the gains in the X1 (90 degree) direction in the frequency of 5 GHz are compared based on FIGS. 9E and 10E, the gain "H2" in FIG. 10E is almost the same as the gain "H1" in FIG. 9E.

[Modified Embodiment]

In a modified embodiment of the present invention, the distance "A" in the transmitting and receiving apparatus 10 may be 4 mm as the minimum distance.

Further, in another modified embodiment of the present invention, the transmitting and receiving apparatus 10 may include a battery having a different shape from that of the button cell battery 80.

The present invention is not limited to the embodiments described above, and may be applicable to, for example, a thermal printing apparatus having no cutting device, namely, a thermal printing apparatus including a thermal head, a platen roller, a motor for driving the platen roller, and a mechanism reducing and transmitting the rotation of the motor for driving the platen roller to the platen roller.

The present application is based on and claims the benefit of priority of Japanese Patent Application No. 2007-308621, filed on Nov. 29, 2007, the entire contents of which are hereby incorporated by reference.

What is claimed is:

1. A transmitting and receiving apparatus comprising:

a UWB antenna including a planar element pattern having a triangular shaped part at one end side thereof in the height direction, and a ground pattern having a first portion disposed on an apex side of the triangular shaped part of the planar element pattern and proximate to the planar element pattern; and a battery disposed on one side of the planar element pattern and separated from the element pattern by a first prescribed distance, wherein the planar element pattern is separated from a second portion of the ground pattern disposed on a same side of the planar element pattern as the battery by a second prescribed distance so that the influence of the planar element pattern on the gain characteristics of the UWB antenna is within a specific, predetermined range by varying the second prescribed distance.

2. The transmitting and receiving apparatus according to claim 1, wherein the width and the height of the planar element pattern are approximately 16 mm and approximately 15 mm, respectively, and the second prescribed distance is equal to or greater than 4 mm.

3. The transmitting and receiving apparatus according to claim 2, wherein the battery is a button-shaped button cell battery and has an negative electrode surface on one side in the thickness direction thereof and positive electrode surfaces on the other side of the thickness direction of and a circumference surface thereof, and the circumference surface of the button cell battery is separated from the end of the planar element pattern by the prescribed distance, and the button cell battery is disposed so that the negative electrode surface is on one side of the element pattern.

4. The transmitting and receiving apparatus according to claim 1, wherein the planar element pattern and the battery are coplanar.

5. The transmitting and receiving apparatus according to claim 1, wherein the planar element pattern is in the shape of a pentagon.

6. The transmitting and receiving apparatus according to claim 1, wherein the UWB antenna is mounted on a circuit substrate and the planar element pattern and the ground pattern are formed on an upper surface of the circuit substrate by an etching process.

7. The transmitting and receiving apparatus according to claim 6, wherein the planar element pattern and the ground pattern are covered with an insulation film.

8. The transmitting and receiving apparatus according to claim 6, further comprising a coaxial connector surface mounted on the upper surface of the circuit substrate at a position above both a part the planar element pattern and a part of the ground pattern.

9. The transmitting and receiving apparatus according to claim 6, wherein the battery is disposed in a cutout portion of the circuit substrate and the cutout portion accommodates a protruding negative electrode terminal member and a protruding positive electrode terminal member.

10. The transmitting and receiving apparatus according to claim 1, wherein the battery has a negative electrode surface and a positive electrode surface and both the negative electrode surface and the positive electrode surface serve as additional ground patterns.

11. The transmitting and receiving apparatus according to claim 1, wherein the planar element pattern and the ground pattern are coplanar.

12. The transmitting and receiving apparatus according to claim 1, wherein the triangular shaped part of the planar element pattern includes two straight edges that converge at a common apex.

* * * * *

UNITED STATES PATENT AND TRADEMARK OFFICE

CERTIFICATE OF CORRECTION

PATENT NO. : 8,253,632 B2
APPLICATION NO. : 12/078943
DATED : August 28, 2012
INVENTOR(S) : Shigemi Kurashima It is certified that error appears in the above-identified patent and that said Letters Patent is hereby corrected as shown below:

Column 6, Line 61, In Claim 8, after "part" insert -- of --.

Signed and Sealed this
Twentieth Day of November, 2012

David J. Kappos

David J. Kappos
*Director of the United States Patent and Trademark Office*